US008555585B2

(12) United States Patent
Dickens

(10) Patent No.: US 8,555,585 B2
(45) Date of Patent: Oct. 15, 2013

(54) PRE-INSULATED STRUCTURAL BUILDING PANELS

(71) Applicant: Radva Corporation, Radford, VA (US)

(72) Inventor: Luther I. Dickens, Radford, VA (US)

(73) Assignee: RADVA Corporation, Radford, VA (US)

( * ) Notice: Subject to any disclaimer, the term of this patent is extended or adjusted under 35 U.S.C. 154(b) by 0 days.

(21) Appl. No.: 13/667,883

(22) Filed: Nov. 2, 2012

(65) Prior Publication Data

US 2013/0055659 A1 Mar. 7, 2013

Related U.S. Application Data

(63) Continuation of application No. 12/614,005, filed on Nov. 6, 2009, now Pat. No. 8,316,612.

(60) Provisional application No. 61/138,803, filed on Dec. 18, 2008, provisional application No. 61/227,586, filed on Jul. 22, 2009.

(51) Int. Cl.
*E04C 1/00* (2006.01)

(52) U.S. Cl.
USPC ..... 52/309.9; 52/745.05; 52/220.2; 52/220.3; 52/220.8

(58) Field of Classification Search
USPC ..... 52/309.4, 309.7, 309.9, 220.1, 220.3, 52/220.7, 220.8
See application file for complete search history.

(56) References Cited

U.S. PATENT DOCUMENTS 4,744,189 A * 5/1988 Wilson ..... 52/511
4,862,660 A * 9/1989 Raymond ..... 52/220.2
5,587,554 A * 12/1996 Kendrick, Jr. ..... 174/37
5,632,127 A * 5/1997 Agar et al. ..... 52/481.2
5,799,462 A * 9/1998 McKinney ..... 52/742.13
6,167,624 B1 * 1/2001 Lanahan et al. ..... 29/897.32
6,178,711 B1 * 1/2001 Laird et al. ..... 52/427

(Continued)

FOREIGN PATENT DOCUMENTS

JP 08-074346 3/1996
JP 10-061067 A 3/1998

(Continued)

OTHER PUBLICATIONS

International Search Report and Written Opinion mailed on Jul. 28, 2010 for a related case PCT/US2009/068250, based on U.S. Appl. No. 12/614,005.

(Continued)

*Primary Examiner* — William Gilbert
*Assistant Examiner* — Alp Akbasli
(74) *Attorney, Agent, or Firm* — McGuireWoods, LLP

(57) ABSTRACT

An apparatus and method for constructing pre-insulated structural panels is disclosed that has a tongue and groove assembly arrangement. Each panel may include one or more c-channels or profiles embedded in expandable polystyrene (EPS) foam to provide structural integrity to the panels, and resulting wall. The panels may be covered with siding, stucco, or similar materials. A chase may be formed horizontally in the panels to provide a wiring conduit through the panel. The panel may also provide when assembled, a vertical chase formed between the mated panels along the length of the panel for wiring. Acoustical properties may be formed in the surface of the EPS portions to provided added acoustical damping measures.

37 Claims, 3 Drawing Sheets

(56) References Cited

U.S. PATENT DOCUMENTS

| | | | | |
|---|---|---|---|---|
| 6,408,594 | B1 * | 6/2002 | Porter | 52/794.1 |
| 6,962,031 | B2 * | 11/2005 | Clarke et al. | 52/802.11 |
| 7,543,419 | B2 * | 6/2009 | Rue | 52/630 |
| 7,665,262 | B2 * | 2/2010 | Blahut | 52/560 |
| 7,790,302 | B2 * | 9/2010 | Ladely (Guevara) et al. | 428/703 |
| 7,841,145 | B2 * | 11/2010 | Pervan et al. | 52/395 |
| 7,874,119 | B2 * | 1/2011 | Pervan et al. | 52/578 |
| 7,992,678 | B2 * | 8/2011 | Pilaar | 181/284 |
| 8,109,055 | B2 * | 2/2012 | Miller | 52/220.7 |
| 8,109,058 | B2 * | 2/2012 | Miller | 52/309.7 |
| 2003/0046892 | A1 * | 3/2003 | Albany et al. | 52/588.1 |
| 2004/0211143 | A1 * | 10/2004 | Hanning | 52/578 |
| 2005/0284061 | A1 * | 12/2005 | Ritchie | 52/309.7 |
| 2006/0191232 | A1 * | 8/2006 | Salazar et al. | 52/606 |
| 2006/0201090 | A1 * | 9/2006 | Guevara et al. | 52/309.12 |
| 2007/0062146 | A1 * | 3/2007 | Van Dijk et al. | 52/580 |
| 2007/0261353 | A1 * | 11/2007 | Cullen | 52/590.2 |
| 2008/0083178 | A1 * | 4/2008 | Feltman et al. | 52/287.1 |
| 2010/0011699 | A1 * | 1/2010 | Weimer et al. | 52/745.1 |

FOREIGN PATENT DOCUMENTS

| | | | |
|---|---|---|---|
| JP | 2005-336964 | A | 12/2005 |
| KR | 10-1997-0027579 | A | 6/1997 |
| WO | 97-09490 | | 3/1997 |
| WO | 97-11236 | A1 | 3/1997 |

OTHER PUBLICATIONS

Translation of KR 10-1997-0027579A provided by Wonsuck Choi who is fluent in Korean and English.

* cited by examiner

PRE-INSULATED STRUCTURAL BUILDING PANELS

CROSS-REFERENCE TO RELATED APPLICATIONS

This is a continuation application of prior copending U.S. non-provisional application Ser. No. 12/614,005, filed Nov. 6, 2009 which claims benefit and priority under 35 U.S.C. §119(e) from U.S. Provisional Application 61/138,803 filed Dec. 18, 2008, entitled PRE-INSULATED STRUCTURAL BUILDING PANELS and also from U.S. Provisional Application 61/227,586 filed Jul. 22, 2009, entitled INSULATED STRUCTURAL WALL SYSTEM, the disclosures of which are incorporated by reference herein in their entirety.

BACKGROUND OF THE INVENTION

1. Field of the Invention

The invention is directed generally to a method and apparatus for pre-insulted structural panels. More particularly, the invention is directed to pre-insulated structural building panels configured with vertical support members, acoustical aspects and wiring friendly features, among other aspects.

2. Related Art

Building construction often employs pre-manufactured components such as building panels that may be assembled in the field to create walls and perimeters of buildings of all sorts. Often the components may include expandable polystyrene foam (EPS), or similar material. The EPS material may provide thermal insulating properties to a degree related to the thickness of the EPS panel.

Moreover, the various types of building components currently available typically have limited features that assist in the installation of the components or finishing off of the building wall surfaces and/or related building functions. Moreover, the currently available products provide limited acoustical dampening aspects.

Furthermore, current building components are often of relatively small size and may require multiple components to create a vertical dimension in the height of a wall, which may require extra installation time and costs.

Accordingly, there is a need for a method and apparatus that provides a pre-insulated building panel with improved features to reduce installation costs and time, while providing improved structural integrity to the resulting wall.

SUMMARY OF THE INVENTION

The invention meets the foregoing need and provides a method and apparatus for constructing a pre-insulated structural panel that includes vertical c-channels or profiles spaced apart for imparting structural integrity to the panel and the c-channels embedded in EPS foam to create the panel. One side of the panel may be configured with a tongue shaped edge that runs along one side of the panel. On the other side of the panel a groove shaped edge may be formed to mate with the tongue shaped edge of another panel when two panels are arranged side-by-side to form a wall section. A fastening plate may be employed to fasten two panels together when placed side-by-side.

In one aspect, a horizontal chase may be provided from one side of the panel to the other side to permit running of wiring through the panel and in a resulting wall. The chase of one panel aligns with a respective chase in another panel when installed. Moreover, a vertical chase may be provided between mated panels proximate the tongue and groove mated surfaces for running wiring or for providing an additional a structural member for added structural strength.

In another aspect, an apparatus for a pre-insulated building component is provided that includes a plurality of vertical support channels embedded in an insulating material to produce a first panel and a second panel, a groove end configured in one side of each panel, and a tongue end configured in another side of each panel, wherein the tongue end of the first panel mates with the groove end of the second panel to form a wall section.

In another aspect, an apparatus for a pre-insulated building component is provided that includes means for constructing an expandable polystyrene (EPS) wall section, wherein the means for constructing includes a means for attaching finishing materials at spaced apart intervals and the means for attaching provides lateral force resistance to the EPS wall section, means for accepting electrical wiring laterally through the interior of the EPS wall section and means for securing the wall section at a bottom end and at a top end, wherein the means for securing at the bottom end and the top end are connected by a means for connecting that traverses an entire height of the wall section.

In another aspect, a method for providing a pre-insulated building component is provided that includes providing a plurality of vertical support channels embedded in an insulating material to produce a first panel and a second panel, providing a groove end configured in one side of each panel, and providing a tongue end configured in another side of each panel, wherein the tongue end of the first panel mates with the groove end of the second panel to form a wall section.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1B:
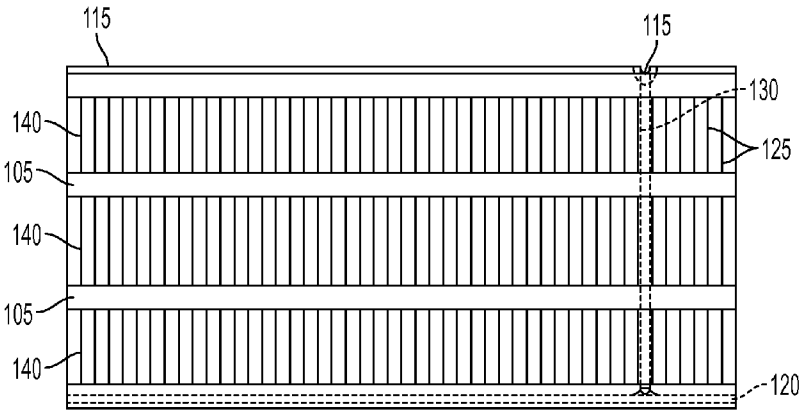
FIG. 1B illustrates a frontal view of the embodiment of FIG. 1A.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

Figure 1C:
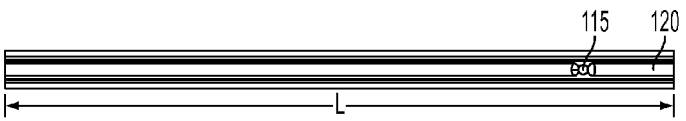
FIG. 1C illustrates a first side-view of the embodiment of FIG. 1A, configured according to principles of the invention.
Figure 1D:
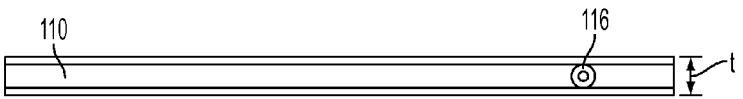
FIG. 1D illustrates a second side-view of the embodiment of FIG. 1A.
Figure 1A:
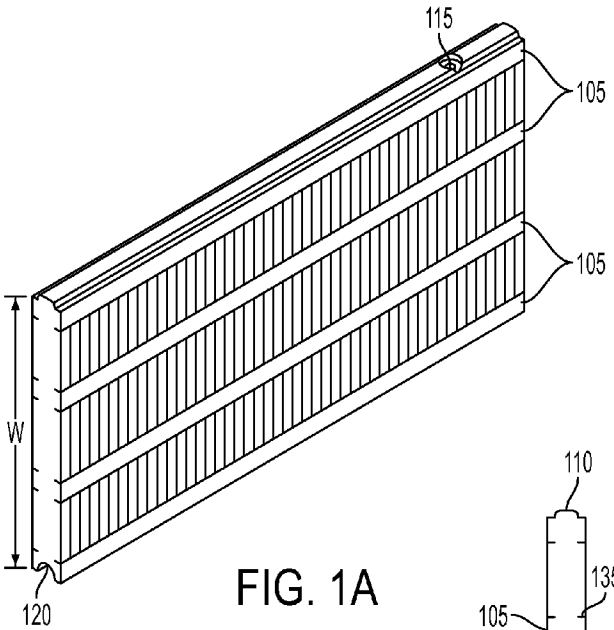
FIG. 1A illustrates in perspective view a pre-insulated structural panel configured according to principles of the invention.
Figure 1E:
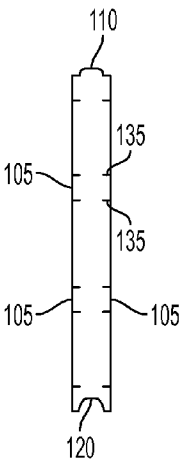
FIG. 1E illustrates an end-view of the embodiment of FIG. 1A.

FIG. 1A is a perspective view of a pre-insulated structural building panel, constructed according to principles of the invention, generally denoted by reference numeral 100. The pre-insulated structural building panel 100 includes a plurality of c-channels 105 that runs the extent of the length (L) of the panel 100. The panel 100 is typically installed with the length (L) oriented vertically, as shown perhaps more clearly in relation to FIG. 2A. The plurality of c-channels 105 may comprise steel channels having lips 135 formed in the sides of the c-channels 105 to embed the c-channels 105 into the expandable polystyrene (EPS) 140 during fabrication of the panels 100. The EPS provides substantial structural support in combination with the c-channels 105. In some embodiments, the c-channels 105 may comprise any metal or plastic type material. During fabrication or molding, the EPS may be injected or molded between opposing c-channels 105 located on both sides of the panel 100, and also continuously between the c-channels 105, whereby the EPS may be substantially continuous along the entire length and height of the panel 100 including between the opposing c-channels.

The panel 100 may be constructed to nearly any required dimension in thickness (t), width (w) and length (L). Common dimensions include about 4, about 8, about 10 or about 12 foot length, 4-6 inch thickness, and 4-6 feet width. But, nearly any dimensionality may be constructed, according to the application need or customer requirements.

The c-channels 105 may be placed at any spacing intervals, such as 4 foot centers, for example, and any spacing to imitate common (or traditional) spacing for "studs." Two-foot center-to-center spacing is also quite common, as is 16 inch spacing. Nearly any spacing, including irregular spacing, may be provided. The c-channels 105 may comprise structural members to facilitate attaching finishing materials such as dry wall, panels, wood siding, vinyl siding, fiber-cement such as Hardiplank®, and the like. The surfaces of the panel 100 may be covered with stucco, gunite, resins, paints, or similar materials, as needed. The c-channels 105 laterally support the EPS and provide substantial weight bearing capability to support the building load generally and to provide attachment capability for siding materials.

Figure 2C:
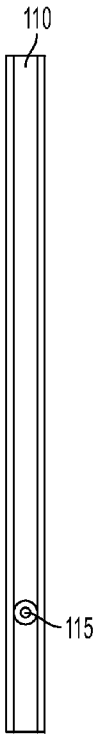
FIG. 2C is a side view of the embodiment of FIG. 2A.
Figure 2A:
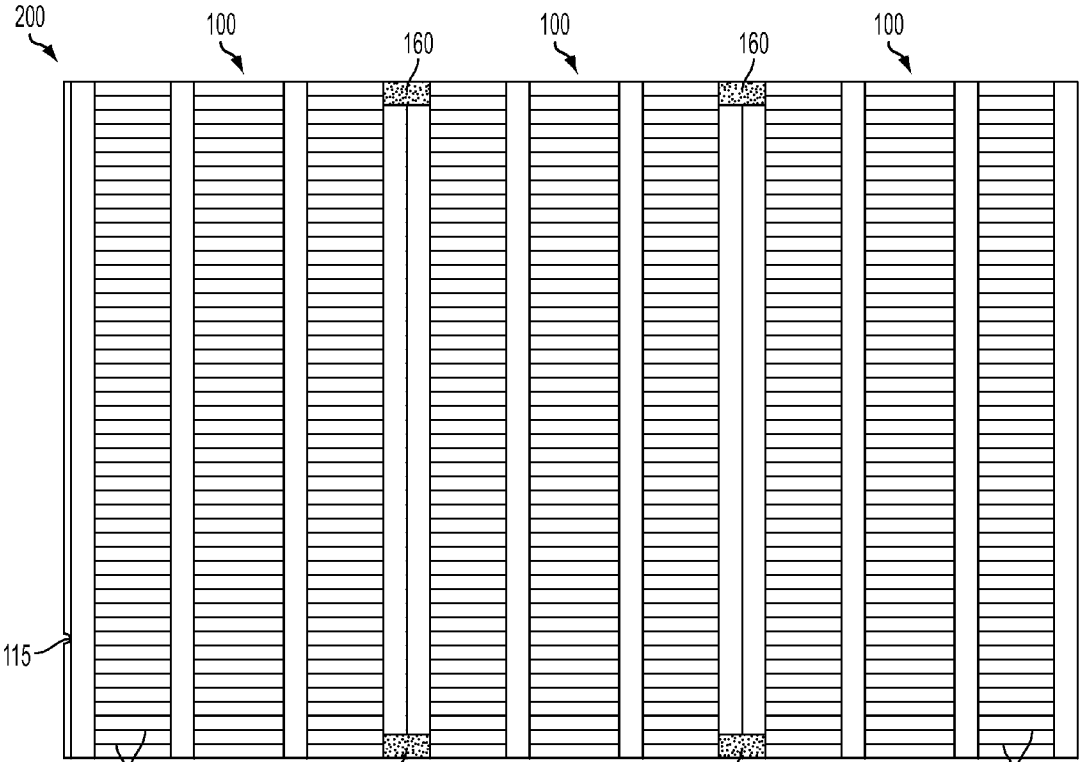
FIG. 2A is a front-view of an embodiment of a plurality of pre-insulated structural panels of FIG. 1A configured to form a wall, according to principles of the invention.
Figure 2B:
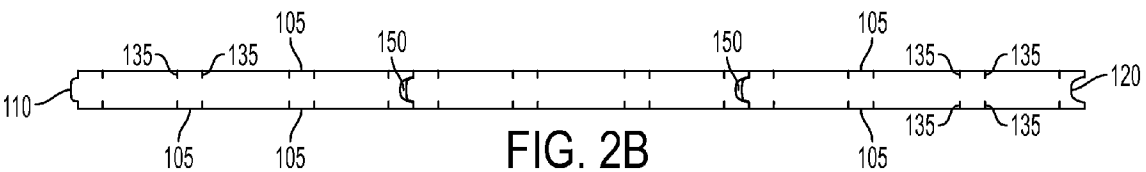
FIG. 2B is a top view of the embodiment of FIG. 2A.

A tongue side 110 and a groove side 120 may be formed along the length (L) of the panel 100, and configured to form a tongue-in-groove assembly when two or more panels 100 are arranged side-by-side, to form a wall section 200 such as shown in relation to FIG. 2A, for example. The tongue side 110 is configured to mate with the groove side 120 of another panel. When so mated, a vertical chase 150 may be formed between the respective tongue and the groove edges as an interior chase along the length (L) of the mated panels 100. The vertical chase 150 may be about one inch in width (i.e., between the lateral tongue edge and the lateral groove edge) to permit installation of wiring between the mated panels 100. Alternatively, a structural strengthening member or stabilizer, such as a metal bar, perhaps having a length of about (L), may be inserted into the vertical chase 150 to provide added strength to the resulting wall, such as for added load bearing capacity, for example. An example of a structural strengthening member is described more fully in relation to FIG. 3, below.

A horizontal chase 130 (as viewed when installed) may be formed (but not always necessary) during the molding fabrication process and configured to extend from the tongue side 110 to the groove side 120, through the interior of the panel 100. The horizontal chase 130 may be about 1½ inches in diameter, but any diameter suitable for a particular application may be constructed. This horizontal chase 130 may provide for accepting wiring runs such as electrical wiring (or perhaps even plumbing) so it may be inserted into or through the panel 100 at the building site to provide power and/or communications, for example. A chase 130 of one panel 100 may align with the chase of an adjacent panel 100, so that wiring may run substantially unimpeded through multiple panels 100. The horizontal chase 130 may be configured with a tapered opening 115, as a lead-in for aiding in guiding inserted wires into the horizontal chase 130, also assisting running of the wire from one panel 100 to an adjacent panel 100.

The EPS portions 140 of the panels 100 may be molded to hold c-channels 105 in place relative to one another using molding techniques of various types. The EPS portions 140 provide substantial structural strength in combination with the c-channels 105. The EPS portions 140 may be constructed with acoustical protrusions 125 on the outer surface of the EPS. The acoustical protrusions 125 may be about ⅛ inch in height, but may vary some. The acoustical protrusions 125 may provide a spacing factor or gap between the EPS outer surface and any applied siding or covering such as dry wall, for example. The extra spacing provided by the acoustical protrusions 125 significantly reduces acoustical noise from penetrating through a finished wall. The acoustical protrusions 125 may be spaced at regular (or perhaps irregular) intervals such as 2 inches, or so, from one another, but can vary, along an extent of a panel so that a sound barrier is also created in a vertical sense so that sound may be prevented, or at least reduced, in propagation ability in a vertical sense along the EPS surface. That is, the series of acoustical protrusions 125 may also inhibit sound propagation laterally along the EPS outer surface, in addition to creating a dampening effect by creation of the space factor or gap. Such a space factor or gap may be created between the EPS foam and any applied finishing materials such as dry wall sheet, siding, or finishing panels, for example, so that the protrusions 125 formed along the width of the EPS portions 140 thereby inhibit sound travel along the surface of the panel, especially, but not limited to, in a vertical sense.

FIG. 2A is a side view of a plurality of pre-insulated structural building panels 100, configured to form a wall section 200. The wall section 200 may be arranged so that a tongue side 110 is mated with a groove side 120 of another panel 100. A fastening plate 160 may be used to fasten the plurality of panels 100 together.

Figure 3B:
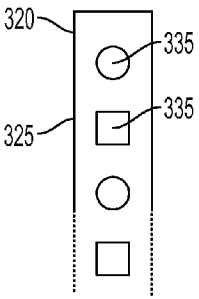
FIG. 3B is a top view of a section of a base plate and/or a header plate with attaching mechanisms, constructed according to principles of the invention.
Figure 3C:
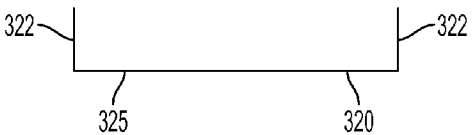
FIG. 3C is an end-on view of the section of FIG. 3B.
Figure 3A:
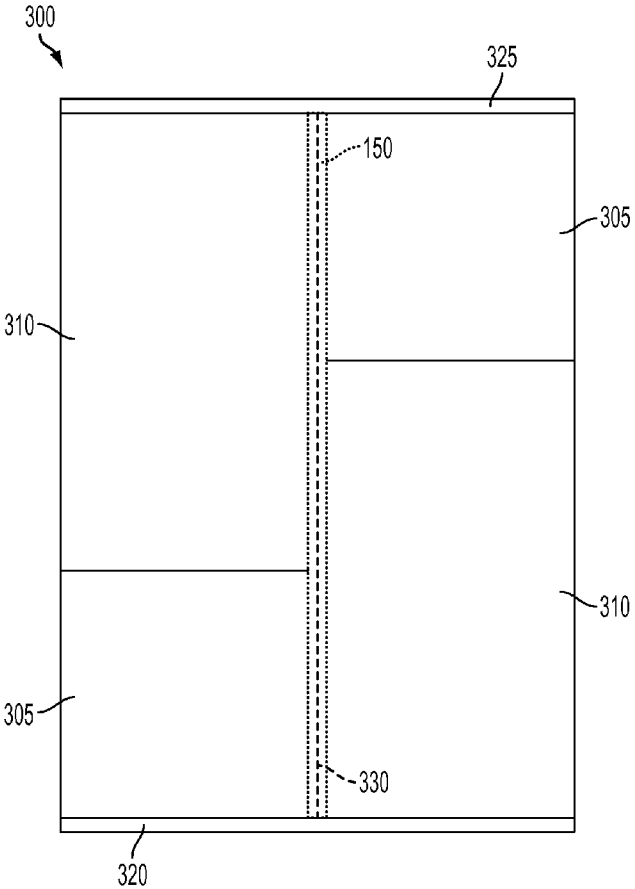
FIG. 3A is an illustration showing an embodiment of a wall section comprising a plurality of pre-insulated structural building panels constructed according to principles of the invention.

FIG. 3A is an illustration of an embodiment of a wall section comprising a plurality of pre-insulated structural building panels constructed according to principles of the invention, the wall section generally denoted by reference numeral 300. The pre-insulated structural building panels 305, 310 comprising the wall section 300 are shown in two different lengths, for example 4 foot panels and 8 foot panels, arranged in a checkerboard fashion, with a longer size panel 310 layered on top of a shorter panel 305 (the pair shown in the left-hand side of FIG. 3A), and then the pair coupled laterally by tongue-in-groove mating, as described previously, with a second pair of panels (the pair shown in the right-hand side in FIG. 3A). The second pair of panels includes a shorter panel 305 layered on top of a longer panel 310. The tongue-in-groove arrangement may be configured to form a vertical chase 150 for receiving a structural strengthening member 330, such as a metal bar, that may extend the entire height of the layered panels (in this example, about 12 feet of extent). In this way, extra strengthening and/or extra stabilizing characteristics may be provided to enhance structural integrity of the side-by-side sets of panels. The checkerboard pattern itself also provides additional resistance to lateral movement of the panels 100. The panels 305, 310 may comprise any embodiments of panel 100. Panels 305 and 310 are shown in FIG. 3A without any c-channels 105 (and several other features of FIGS. 1A-1C) to permit enhancement of particular features being described in relation to FIG. 3A, but the c-channels 105 (and the other features of FIGS. 1A-1C) may be interpreted as being included in the embodiment of FIG. 3A.

Further, an optional based plate 320, mountable to a floor or other surface, may have lips 322 configured to receive the lower side of the respective lower panels 305, 310. The base plate 320 may serve at least in part to stabilize the wall section 300 to a floor, or similar surface, and may be of any length to match any number of side-by-side panels being installed for an application. The base plate 320 may be configured with one or more attaching mechanisms 335 (see the top view of the base plate/header plate as shown in FIG. 3B), which may be holes, to secure the structural strengthening member 330 to the base plate 320. Moreover, an optional header plate 325 may be employed at the top of the upper panels 305, 310 to provide added structural integrity at the top of the wall section 300. The header plate 325 may be configured similarly to the base plate 320, as shown in relation to the end-on view of FIG. 3C. The header 325 may also have lips 322 and may also have attaching mechanism 335 to receive the structural strengthening member 330. The header 325 may be secured to an appropriate structure for securing the wall section 300 at the top and may be of any length to match any number of side-by-side panels being installed for an application. The structural strengthening member 330 may be cut to length, as needed, which may be more than 12 feet in this example.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed:

1. An apparatus for a pre-insulated building component, comprising:

a plurality of vertical support channels embedded in an insulating material to produce a first panel and a second panel, each panel having a first side, a second side opposing the first side, a third side, and a fourth side opposing the third side, wherein a first subset of the plurality of vertical support channels are configured along the third side without extending to the fourth side and a second subset of the plurality of vertical support channels are configured along the fourth side without extending to the third side, the insulating material separating the first subset from the second subset, the insulating material bonded to the plurality of vertical support channels with a thermosetting adhesive;

a groove end configured in the first side of each panel, the groove end having a substantially symmetrical concave recess formed by the insulating material along a length of the first side; and a tongue end configured in the second side of each panel, the tongue end having a substantially symmetrical convex portion integrally formed by the insulating material along a length of the second side, wherein the symmetrical concave recess of the first panel is configured to receive the symmetrical convex portion of the second panel for forming a wall section, and the symmetrical concave recess and symmetrical convex portion being configured to form an enclosed vertical chase of therebetween when mated thereby permitting installation of wiring or plumbing, and wherein the concave recess and the convex portion each has a radius forming curved portion that are configured to mutually mate.

2. The apparatus of claim 1, wherein the insulating material comprises expandable polystyrene (EPS).

3. The apparatus of claim 1, further comprising a chase configured in each panel to run from the first side to the second side for receiving wiring, the chase having a diameter and being defined solely by the insulating material.

4. The apparatus of claim 3, wherein the chase of the first panel aligns with the chase of the second panel thereby permitting wiring to extend from the first panel into the second panel.

5. The apparatus of claim 1, wherein a plurality of acoustical protrusions are configured on a surface of the insulating material to inhibit sound travel along a space formed between the surface of at least one of the panels and a finishing material applied to the at least one of the panels, wherein the plurality of acoustical protrusions are formed by the insulating material as separate spaced apart parallel protrusions configured to run horizontally on the surface of the third side from one vertical support column to another vertical support column.

6. The apparatus of claim 1, wherein the plurality of vertical support channels are spaced apart to imitate spacing associated with traditional wall studs, the spacing being one of: about 16 inches and about 24 inches.

7. The apparatus of claim 1, wherein the plurality of vertical support channels have one surface exposed to facilitate attaching of finishing materials.

8. The apparatus of claim 1, wherein the plurality of vertical support channels comprised c-channels, wherein a portion of the c-channels embed within expandable polystyrene to provide lateral support against lateral forces, and the plurality of vertical support channels provide load bearing support, the c-channel configured with a base portion configured to form part of an outer surface of at least one of the third side and the fourth side and the base portion configured with two lip portions, each lip portion extending perpendicular from the base portion, the two lips terminating in the insulating material without any bends in the two lip portions, other than any bend formed with the base portion.

9. The apparatus of claim 1, wherein the panel has a length of one of: about 4 feet, about 8 feet, about 10 feet, and about 12 feet.

10. The apparatus of claim 1, further comprising a base plate to receive the wall section at a bottom end of the wall section and for securing the wall section to a floor.

11. The apparatus of claim 10, further comprising a header plate for securing the wall section at a top end of the wall section.

12. The apparatus of claim 11, further comprising a structural strengthening member arranged to extend from the header plate to the base plate through the enclosed vertical chase formed in the wall section by at least the first panel and the second panel.

13. The apparatus of claim 1, further comprising a structural strengthening member arranged in the vertical chase for providing additional structural integrity.

14. The apparatus of claim 1, wherein the enclosed vertical chase comprises a circumferentially enclosed vertical chase formed by the mated tongue end and groove end.

15. The apparatus of claim 1, wherein a first vertical channel of the plurality of channels being configured to form an edge between the third side and first side; and a second vertical channel of the plurality of channels being configured to form an edge between the third side and second side, and a third vertical channel of the plurality of channels being configured to form an edge between the first side and fourth side; and a fourth vertical channel of the plurality of channels being configured to form an edge between the fourth side and second side.

16. The apparatus of claim 15, wherein the symmetrical concave recess is configured between the first vertical channel and the fourth vertical channel, and the convex portion is configured between the second vertical channel and the third vertical channel.

17. The apparatus of claim 1, wherein the symmetrical concave recess is configured with a radius and the symmetrical convex portion is configured with a radius, the symmetrical convex portion configured to extend partially into the concave recess when mated to create the vertical chase, the vertical chase being a space between the symmetrical concave recess and symmetrical convex portion along an entire vertical height of the mated panels.

18. An apparatus for a pre-insulated building component, comprising;

at least one first vertical c-channel arranged along a first outer surface of a panel without extending to an opposing outer surface of the panel;

at least one second vertical c-channel arranged along a second outer surface of the panel without extending to an opposing outer surface of the panel; and insulating material embedding the at least one first vertical c-channel and the insulating material embedding the at least one second vertical c-channel, the insulating material spacing part and separating the at least one first vertical c-channel from the at least one second vertical c-channel, wherein the insulating material is bonded to the at least one first vertical c-channel and the at least one second vertical c-channel with a thermosetting adhesive, and wherein the at least one first vertical c-channel has a first lip and the at least one second vertical c-channel has a second lip, the first lip forming a first edge in a third outer surface of the panel and second lip forming a second edge in the third outer surface of the panel, the at least one first vertical c-channel has a first lip and the at least one second vertical c-channel has a second lip, the first lip forming a first edge in a third outer surface of the panel and second lip forming a second edge in the third outer surface of the panel, the insulating material configured to form a curved concave recess vertically along the fourth surface and the insulting material configured to form a curved convex portion formed as an integral part of the panel between the first lip and second lip vertically on a third outer surface, wherein the panel is configured to be mated with a second panel, the second panel configured like the panel, the mating of the curved concave recess of the panel with the curved convex portion of the second panel forming an enclosed vertical chase between the concave recess and the convex portion to permit wiring or a strengthening member to be inserted therein.

19. The apparatus of claim 18, wherein the insulating material is expandable polystyrene (EPS).

20. The apparatus of claim 18, wherein the insulating material is configured to form a plurality of horizontal protrusions extending along a width of at least one of the outer surfaces between two adjacent vertical channels, the plurality of horizontal protrusions configured to abut finishing material applied to the panels to minimize sound propagation along at least one of the outer surfaces of the panel.

21. The apparatus of claim 18, wherein the first lip and the second lip each form a flat surface portion on the third outer surface, the first lip and second lip each adjacent to a convex portion formed by the third outer surface.

22. The apparatus of claim 21, wherein a third vertical c-channel has a third lip and a fourth vertical c-channel has a fourth lip, the third lip forming a third edge in a fourth outer surface of the panel and the fourth lip forming a fourth edge in the fourth outer surface of the panel, wherein the third lip and fourth lip each form a flat surface portion on the fourth surface.

23. The apparatus of claim 22, wherein the third vertical c-channel and fourth vertical c-channel are configured on opposing outer surfaces of the panel, and the third lip and fourth lip each adjacent to a concave portion formed in the fourth outer surface, the concave portion formed between the first lip and the second lip.

24. The method of claim 18, wherein the mated concave recess of the panel with the convex portion of the second panel forms the enclosed vertical chase between the convex recess and the concave portion and also forms a space of about one inch between the concave recess and the convex portion.

25. A method for providing a pre-insulated building component, comprising the steps of:

providing a plurality of vertical support channels embedded in an insulating material to produce a first panel and a second panel, each panel having a first side, a second side opposing the first side, a third side, and a fourth side opposing the third side, wherein a first subset of the plurality of vertical support channels are configured along the third side without extending to the fourth side and a second subset of the plurality of vertical support channels are configured along the fourth side without extending to the third side, the insulating material separating the first subset from the second subset, the insulating material bonded to the plurality of vertical support channels with a thermosetting adhesive;

providing a groove end configured in the first side of each panel, the groove end having a concave recess formed by the insulating material along a length of the first side, and a first vertical channel of the plurality of channels configured to form an edge between the third side and first side; and providing a tongue end configured in the second side of each panel, the tongue end having a convex portion formed by the insulating material along a length of the second side, and a second vertical channel of the plurality of channels configured to form an edge between the third side and second side wherein the tongue end of the first panel mates with the groove end of the second panel to form a wall section, and the mated tongue end and groove end forming an enclosed vertical chase between the convex portion and the concave recess, and the first vertical channel further configured to extend along the first side terminating proximate the concave recess, and the second vertical channel configured to extend along the second side terminating proximate the convex portion, wherein the concave recess and the convex portion each has a radius forming a curved portion that are configured to mutually mate, and the concave recess is an integral part of the tongue end.

26. The method of claim 25, wherein the insulating material comprises expandable polystyrene (EPS).

27. The method of claim 25, further comprising providing a chase configured in each panel to run a width of each panel for receiving wiring.

28. The method of claim 27, wherein the step for providing a chase in the first panel aligns with the chase in the second panel thereby permitting wiring to extend from the first panel into the second panel.

29. The method of claim 25, further comprising providing a base plate to secure the wall section to a floor and a header plate to secure the wall section at a top end of the wall section.

30. The method of claim 29, further comprising providing a structural strengthening member attached to the base plate and the header plate and arranged in a vertical chase formed in the wall section.

31. The method of claim 25, wherein the step of providing a plurality of vertical support channels provides the plurality of vertical support channels spaced apart to imitate spacing associated with traditional wall studs.

32. The method of claim 25, further comprising providing a plurality of acoustical protrusions of about ⅛ inch in height configured on a surface of the insulating material of the third side and fourth side for dampening sound.

33. The method of claim 32, wherein the plurality of acoustical protrusions are configured to inhibit sound travel along a space formed between the surface of at least one of the panels and a finishing material applied to the at least one of the panels, wherein the plurality of acoustical protrusions are formed solely by the insulating material as separate spaced apart parallel protrusions configured to run horizontally on the surface of the third side from one vertical support column to another vertical support column, and the plurality of acoustical protrusions are formed solely by the insulating material as separate spaced apart parallel protrusions configured to run horizontally on the surface of the fourth side from one vertical support column to another vertical support column.

34. The method of claim 32, wherein in the step of providing a plurality of acoustical protrusions provides the plurality of acoustical protrusions spaced apart vertically from one another along an extent of at least one panel.

35. The apparatus of claim 25, wherein a third vertical channel of the plurality of channels is configured to form an edge between the fourth side and the second side, and a fourth vertical channel of the plurality of channels is configured to form an edge between the fourth side and the first side.

36. The apparatus of claim 35, wherein a the groove end has a concave recess formed in a surface of the groove end between the first vertical channel and fourth vertical channel, and the tongue end has a convex portion formed by a surface of the tongue end between the second vertical channel and the third vertical channel.

37. The method of claim 25, wherein the mated tongue end and groove end forms the enclosed vertical chase between the convex portion and the concave recess, the enclosed vertical chase forming a space of about one inch between the tongue end and groove end.

* * * * *